US005788106A

United States Patent [19]

Hotinski

[11] Patent Number: 5,788,106

[45] Date of Patent: Aug. 4, 1998

[54] BEVERAGE CONTAINER WITH AN INTEGRAL POP-UP STRAW

[76] Inventor: Steven Hotinski, 287 College Ave., Staten Island, N.Y. 10314

[21] Appl. No.: 701,465

[22] Filed: Aug. 22, 1996

Related U.S. Application Data

[63] Continuation-in-part of Ser. No. 529,835, Sep. 18, 1995, abandoned.

[51] Int. Cl.[6] ..... A47G 19/22

[52] U.S. Cl. ..... 220/269; 220/906; 220/709; 220/705

[58] Field of Search ..... 220/269, 705, 220/707, 708, 709, 706, 710, 906; 215/388, 389; 229/103.1

[56] References Cited

U.S. PATENT DOCUMENTS

| | | | |
|---|---|---|---|
| 2,613,988 | 10/1952 | Jarbeau | 215/388 X |
| 4,228,913 | 10/1980 | Mack et al. | 220/710 |
| 4,356,927 | 11/1982 | Cooper et al. | 215/388 X |
| 4,709,829 | 12/1987 | Johnson et al. | 220/706 |
| 4,892,187 | 1/1990 | Stein | 215/388 X |
| 5,054,639 | 10/1991 | Ahn | 220/706 |
| 5,148,971 | 9/1992 | Ahn | 215/389 X |
| 5,361,935 | 11/1994 | Sagucio | 220/705 X |
| 5,431,297 | 7/1995 | Rosello | 220/705 X |

*Primary Examiner*—Allan N. Shoap
*Assistant Examiner*—Nathan Newhouse

[57] ABSTRACT

A beverage container with an integral pop-up straw comprised of a cylindrical container. A channel guide is secured within a bottom end of the cylindrical container. A straw is received within the channel guide. Once the cylindrical container is opened, the straw will pop out of the opening from the channel guide.

6 Claims, 5 Drawing Sheets

BEVERAGE CONTAINER WITH AN INTEGRAL POP-UP STRAW

RELATED APPLICATION

This application is a continuation-in-part of U.S. patent application Ser. No. 08/529,835 filed on Sep. 18, 1995 now abandoned.

BACKGROUND OF THE INVENTION

1. Field of the Invention

The present invention relates to a beverage container with an integral pop-up straw and more particularly pertains to maintaining a drinking straw within a container for use upon opening the container with a beverage container with an integral pop-up straw.

2. Description of the Prior Art

The use of beverage containers with straws is known in the prior art. More specifically, beverage containers with straws heretofore devised and utilized for the purpose of incorporating a straw with a beverage container are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,353,955 to Kaufman et al. discloses a beverage container having a flexible straw fluidly connected at the proximal end thereof.

U.S. Pat. No. 5,253,779 to Lee discloses a beverage container having a self-contained pop-up straw associated therewith.

U.S. Pat. No. 5,174,469 to Policapelli discloses a partially collapsible container which features a drinking straw extending upwardly therefrom.

U.S. Pat. No. 5,188,283 to Gu discloses a beverage container with concealed straw.

U.S. Pat. No. 5,160,058 to Ahn discloses a beverage bottle with floating straw.

U.S. Pat. No. 5,054,631 to Robbin, III discloses disposable beverage containers having integral drinking straws.

While these devices fulfill their respective, particular objective and requirements, the aforementioned patents do not describe a beverage container with an integral pop-up straw for maintaining a drinking straw within a container for use upon opening the container.

In this respect, the beverage container with an integral pop-up straw according to the present invention substantially departs from the conventional concepts and designs of the prior art, and in doing so provides an apparatus primarily developed for the purpose of maintaining a drinking straw within a container for use upon opening the container.

Therefore, it can be appreciated that there exists a continuing need for new and improved beverage container with an integral pop-up straw which can be used for maintaining a drinking straw within a container for use upon opening the container. In this regard, the present invention substantially fulfills this need.

SUMMARY OF THE INVENTION

In the view of the foregoing disadvantages inherent in the known types of beverage containers with straws now present in the prior art, the present invention provides an improved beverage container with an integral pop-up straw. As such, the general purpose of the present invention, which will be described subsequently in greater detail, is to provide a new and improved beverage container with an integral pop-up straw and method which has all the advantages of the prior art and none of the disadvantages.

To attain this, the present invention essentially comprises a cylindrical container having a top end, a bottom end, and a surrounding side wall therebetween. The cylindrical container has a hollow interior being adapted to hold a liquid beverage therein. The top end has an opening formed therethrough. The opening has a cover removably disposed therein. The top end has a pull tab secured thereto. The pull tab has a first end portion, a second end portion, and an intermediate portion therebetween. The intermediate portion is pivotally secured to the top end adjacent to the opening whereby lifting up on the first end causes the second end to push the cover through the top end to expose the opening therethrough. A channel guide is secured to the bottom end of the cylindrical container within the hollow interior thereof. The channel guide aligns with the opening in the top end of the container. The channel guide has an open upper portion. A bracket portion is secured between the open upper portion and the surrounding side wall of the cylindrical container. The device includes a bendable straw having a first end and a second end. The first end is received within the open end portion of the channel guide. The second end has a drinking aperture formed therethrough.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage container with an integral pop-up straw which has all the advantages of the prior art beverage containers with straws and none of the disadvantages.

It is another object of the present invention to provide a new and improved beverage container with an integral pop-up straw which may be easily and efficiently manufactured and marketed.

It is a further object of the present invention to provide a new and improved beverage container with an integral pop-up straw which is of durable and reliable construction.

An even further object of the present invention is to provide a new and improved beverage container with an integral pop-up straw which is susceptible of a low cost of manufacture with regard to both materials and labor, and which accordingly is then susceptible of low prices of sale to the consuming public, thereby making such a beverage container with an integral pop-up straw economically available to the buying public.

Still yet another object of the present invention is to provide a new and improved beverage container with an integral pop-up straw which provides in the apparatuses and methods of the prior art some of the advantages thereof, while simultaneously overcoming some of the disadvantages normally associated therewith.

Even still another object of the present invention is to provide a new and improved beverage container with an integral pop-up straw for maintaining a drinking straw within a container for use upon opening the container.

Lastly, it is an object of the present invention to provide a new and improved beverage container with an integral pop-up straw comprised of a cylindrical container. A channel guide is secured within a bottom end of the cylindrical container. A straw is received within the channel guide. Once the cylindrical container is opened, the straw will pop out of the opening from the channel guide.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
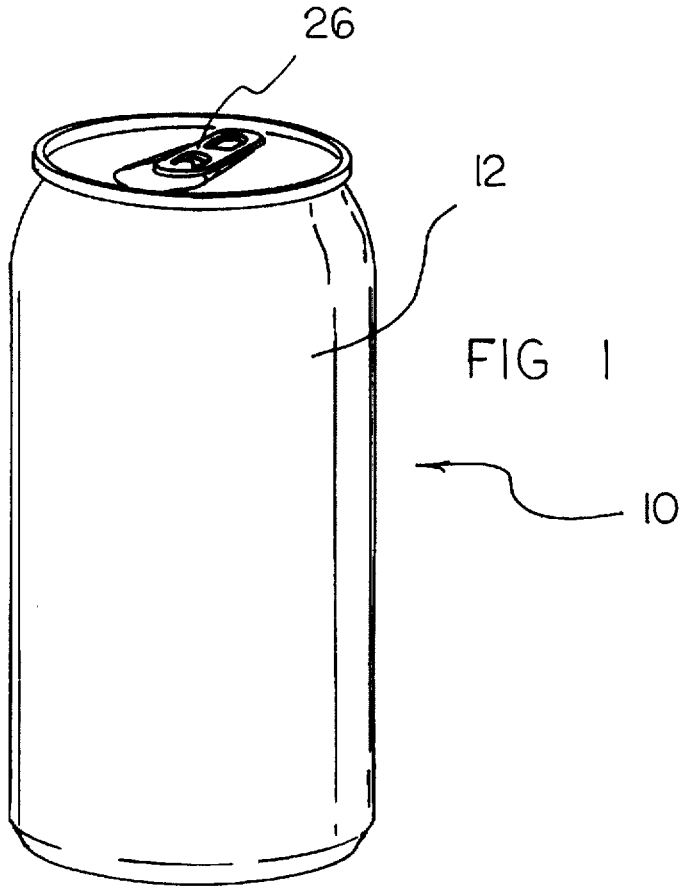
FIG. 1 is a perspective view of the preferred embodiment of the beverage container with an integral pop-up straw constructed in accordance with the principles of the present invention.
Figure 2:
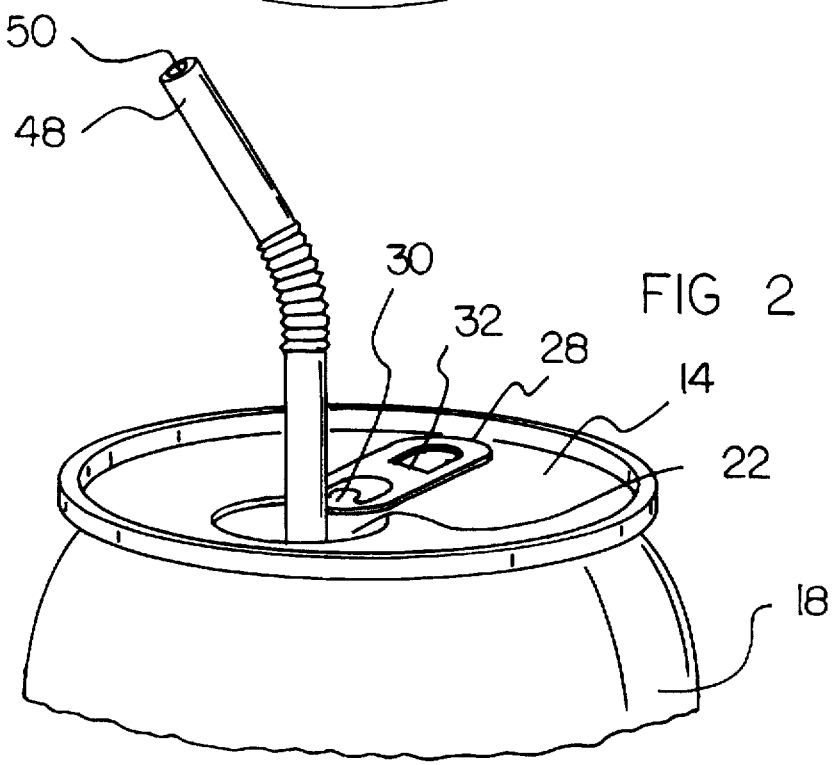
FIG. 2 is an elevated sectional front view of the present invention illustrating the upper surface of the container.
Figure 3:
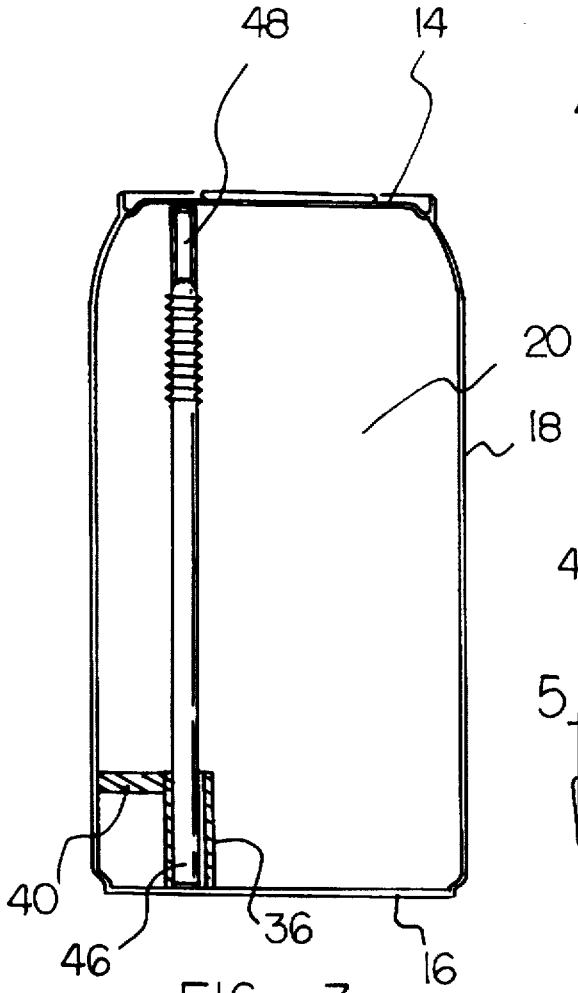
FIG. 3 is a cross-sectional view of the present invention illustrating the straw secured within the guide channel.
Figure 4:
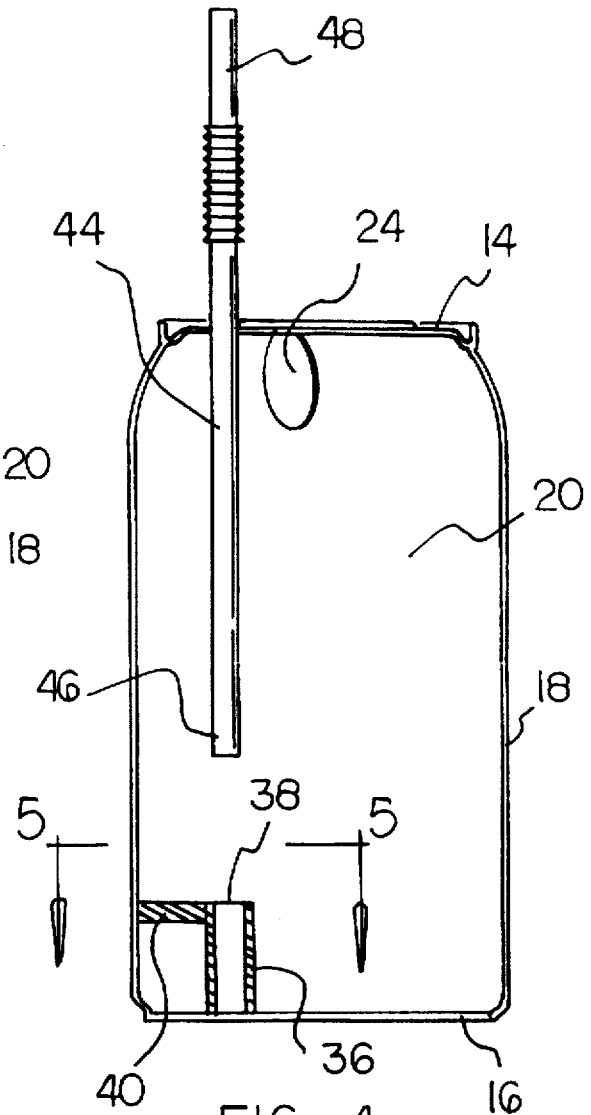
FIG. 4 is a cross-sectional view of the present invention illustrating the straw ejected from the guide channel.
Figure 5:
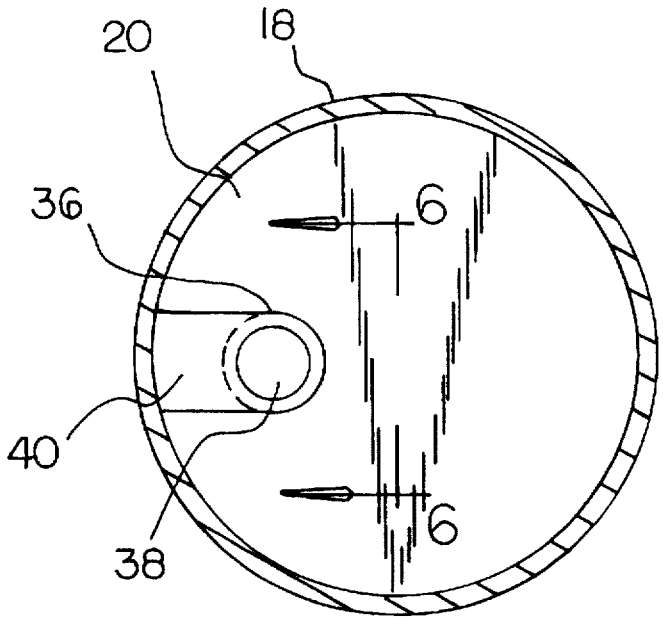
FIG. 5 is a cross-sectional view as taken along line 5—5 of FIG. 4.
Figure 6:
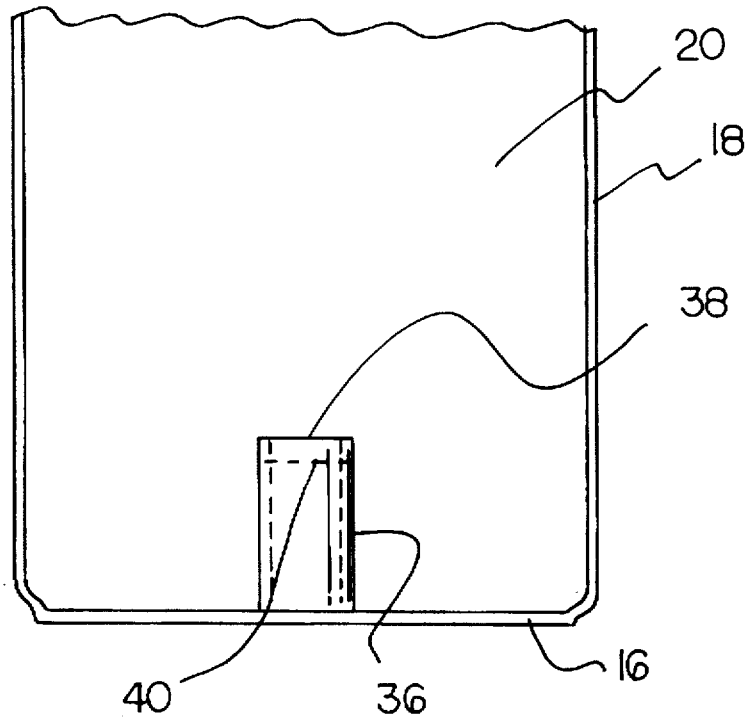
FIG. 6 is a cross-sectional view as taken along line 6—6 of FIG. 5.

With reference now to the drawings, and in particular, to FIG's 1–10 thereof, the preferred embodiment of the new and improved beverage container with an integral pop-up straw embodying the principles and concepts of the present invention and generally designated by the reference number 10 will be described.

Specifically, it will be noted in the various Figures that the device relates to a new and improved beverage container with an integral pop-up straw for maintaining a drinking straw within a container for use upon opening the container. In its broadest context, the device consists of a cylindrical container, a channel guide, and a bendable straw. Such components are individually configured and correlated with respect to each other so as to attain the desired objective.

The device 10 includes a cylindrical container 12 having a top end 14, a bottom end 16, and a surrounding side wall 18 therebetween. The cylindrical container 12 has a hollow interior 20 being adapted to hold a liquid beverage therein. The top end 14 has an opening 22 formed therethrough. The opening 22 has a cover 24 removably disposed therein. The top end 14 has a pull tab 26 secured thereto. The pull tab 26 has a first end portion 28, a second end portion 30, and an intermediate portion 32 therebetween. The intermediate portion 32 is pivotally secured to the top end 14 adjacent to the opening 22 whereby lifting up on the first end 28 causes the second end 30 to push the cover 24 through the top end 14 to expose the opening 22 therethrough in an open configuration.

A channel guide 36 is secured to the bottom end 16 of the cylindrical container 12 within the hollow interior 20 thereof. The channel guide 36 aligns with the opening 22 in the top end 14 of the container 12. The channel guide 36 has an open upper portion 38. A bracket portion 40 is secured between the open upper portion 38 and the surrounding side wall 18 of the cylindrical container 12. The bracket portion 40 is about half of the length of the channel guide 36.

The device 10 includes a bendable straw 44 having a first end 46 and a second end 48. The first end 46 is received within the open end portion 38 of the channel guide 36. The second end 48 has a drinking aperture 50 formed therethrough. The depth of the channel guide 36 is less than twenty-five percent of the length of the bendable straw 44. The drinking aperture 50 of the bendable straw 44 is sealed before the opening 22 is exposed thereby allowing the straw 44 to be filled with air. Thus once the opening 22 is exposed, the air filled straw 44 will eject outwardly of the opening 22 for use by the drinker. The drinking aperture 50 can be accessed by squeezing the edges together to break the seal. The bendable straw 44 is the same length as the length of the cylindrical container 12, thus when the first end 46 of the straw 48 is inserted into the channel guide 36, the second end of the straw 48 will abut the cover 24 over the opening 22.

Figure 7:
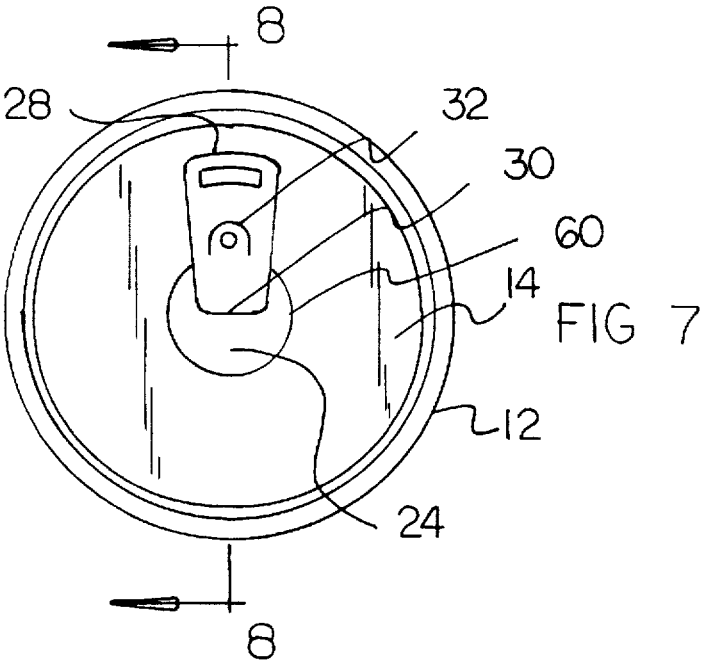
FIG. 7 is a plan view of a second embodiment of the present invention.
Figure 8:
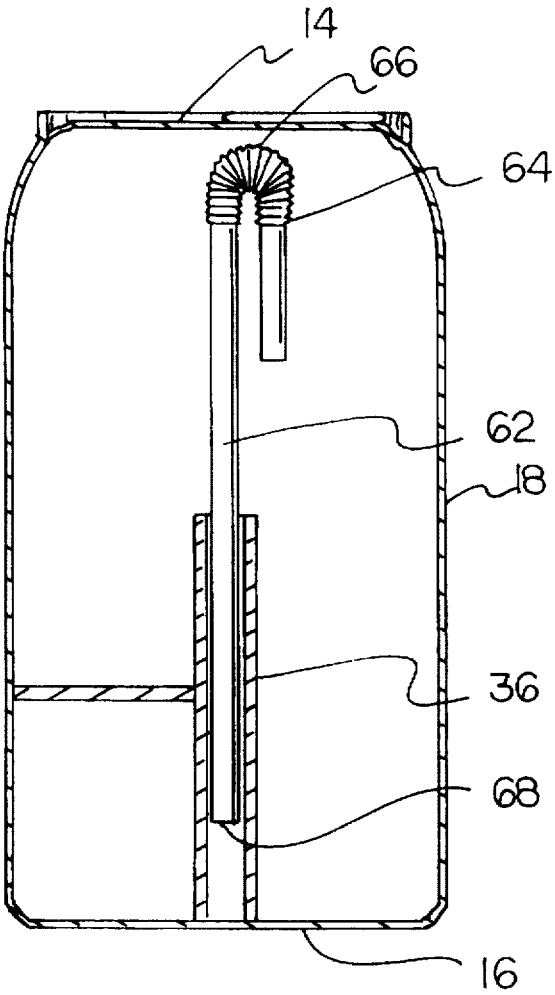
FIG. 8 is a cross-sectional view as taken along line 8—8 of FIG. 7.
Figure 9:
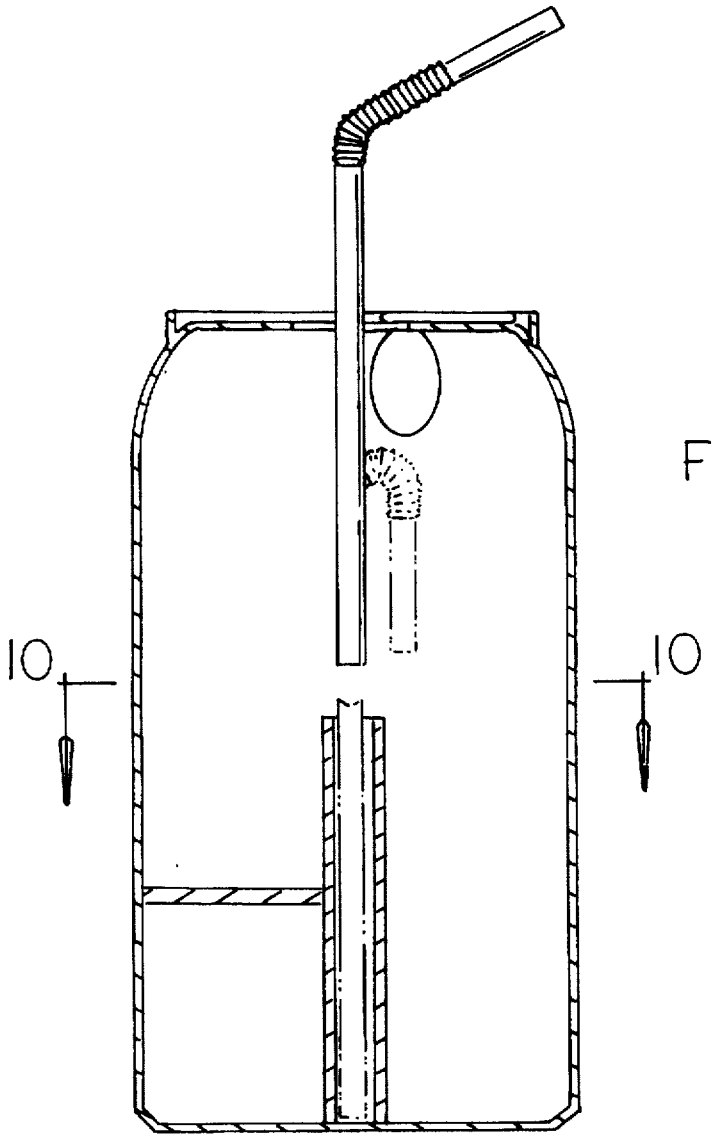
FIG. 9 is a cross-sectional side view of the second embodiment of the present invention illustrating the straw ejected from the guide channel.
Figure 10:
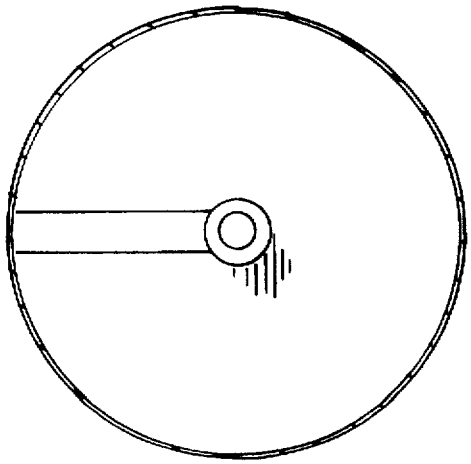
FIG. 10 is a cross-sectional view as taken along line 10—10 of FIG. 9.

A second embodiment of the present invention is shown in FIGS. 7–10 and includes substantially all of the components of the present invention wherein the channel guide 36 is centrally disposed on the bottom end 16 of the cylindrical container 12. The channel guide 36 has a length of about half of a length of the cylindrical container 12. The cylindrical container 12 has a centrally disposed opening 60 through a top end 14 thereof whereby the opening 60 is in alignment with the channel guide 36. The opening 60 has the cover 24 removably disposed therein. The top end 14 has the pull tab 26 secured thereto. The straw 44 further includes an elongated lower portion 62 and a flexible upper portion 64. The elongated lower portion 62 is positioned within the channel guide 36. The flexible upper portion 64 is parallel with the elongated lower portion 62 when within the cylindrical container 10 when the cylindrical container 12 is in a closed configuration. A bend 66 formed in the flexible upper portion 64 abuts the cover 24 of the opening 22 of the cylindrical container 12 and a distal end 68 of the elongated lower portion 62 is raised above the bottom end 16 of the cylindrical container 12. Exposing the opening 22 of the cylindrical container 12 is achieved by pushing the cover 24 through the top end 14 to expose the opening 22 through the container 12. Thus, pushing downwardly on the straw 44 will cause the flexible upper portion 64 to extend linearly with respect to the elongated lower end 62 and extend outwardly of the opening 22 in the cylindrical container 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the united states is as follows:

1. A beverage container with an integral pop-up straw for maintaining a drinking straw within a container for use upon opening the container comprising, in combination:

a cylindrical container having a top end, a bottom end, and a surrounding side wall therebetween, the cylindrical container having a hollow interior holding a liquid beverage therein, the top end having an opening formed therethrough, the opening having a cover removably disposed therein, the top end having a pull tab secured thereto, the pull tab having a first end portion, a second end portion and an intermediate portion therebetween, the intermediate portion being pivotally secured to the top end adjacent to the opening whereby lifting up on the first end causes the second end to push the cover through the top end to expose the opening therethrough;

a vertically extending channel guide secured to the bottom end of the cylindrical container within the hollow interior thereof, the channel guide aligning with the opening in the top end of the container, the channel guide having an open upper portion, a bracket portion secured between the open upper portion and the surrounding side wall of the cylindrical container;

a bendable straw having a first end and a second end, the first end received within the open end portion of the channel guide, the second end having a drinking aperture formed therethrough.

2. The beverage container as set forth in claim 1 wherein the channel guide being centrally disposed on the bottom end of the cylindrical container.

3. The beverage container as set forth in claim 2 wherein the cylindrical container having a centrally disposed opening through a top end.

4. The beverage container as set forth in claim 3 wherein the straw further including an elongated lower portion and a flexible upper portion, the elongated lower portion positioned within the channel guide, the flexible upper portion parallel with the elongated lower portion within the cylindrical container when in a closed configuration whereby a bend formed in the flexible upper portion abuts the cover of the opening of the cylindrical container and a distal end of the elongated lower portion being raised above the bottom end of the cylindrical container.

5. The beverage container as set forth in claim 4 wherein exposing the opening of the cylindrical container is achieved by pushing the cover through the top end to expose the opening through the container thereby pushing downwardly on the straw whereby the flexible upper portion will extend linearly with respect to the elongated lower end and extend outwardly of the opening in the cylindrical container.

6. The beverage container as set forth in claim 1 wherein the channel guide having a length of about half of a length of the cylindrical container.

* * * * *